US010400559B2

(12) United States Patent
Webber et al.

(10) Patent No.: US 10,400,559 B2
(45) Date of Patent: Sep. 3, 2019

(54) DIFFUSER AND FLOW CONTROL SYSTEM WITH DIFFUSER

(71) Applicants: Andrew John Webber, Hockley, TX (US); Evan Williams, Tomball, TX (US); Santos Manzano, Cypress, TX (US)

(72) Inventors: Andrew John Webber, Hockley, TX (US); Evan Williams, Tomball, TX (US); Santos Manzano, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 699 days.

(21) Appl. No.: 14/981,143

(22) Filed: Dec. 28, 2015

(65) Prior Publication Data

US 2016/0215599 A1 Jul. 28, 2016

Related U.S. Application Data

(60) Provisional application No. 62/106,255, filed on Jan. 22, 2015.

(51) Int. Cl.
*E21B 43/12* (2006.01)
*F15D 1/00* (2006.01)
(Continued)

(52) U.S. Cl.
CPC ..... *E21B 43/12* (2013.01); *E21B 17/00* (2013.01); *E21B 34/14* (2013.01); *F15D 1/00* (2013.01);
(Continued)

(58) Field of Classification Search
CPC ..... E21B 43/12; E21B 17/00; E21B 34/14; E21B 2033/005; E21B 2034/007
(Continued)

(56) References Cited

U.S. PATENT DOCUMENTS 3,107,764 A * 10/1963 Fulton ..... F16D 41/063 192/41 R
5,316,084 A * 5/1994 Murray ..... E21B 33/1208 166/332.4
(Continued)

FOREIGN PATENT DOCUMENTS

WO 2014201458 A1 12/2014

OTHER PUBLICATIONS

Notification of Transmittal of the International Search Report and the Written Opinion of the International Searching Authority, or the Declaration; PCT/US2015/067810; dated Apr. 27, 2016; 5 pages ISR, 6 pages WO; total 11 pages.

*Primary Examiner* — Anna M Momper
*Assistant Examiner* — Patrick F Lambe
(74) *Attorney, Agent, or Firm* — Cantor Colburn LLP

(57) ABSTRACT

A flow control system including a mandrel having one or more ports; one or more seals in sealing contact with the mandrel; a housing positioned about the mandrel and one or more seals and in sealing contact with the one or more seals. One or more diffusers placed in a fluid pathway of the flow control system. The one or more diffusers including an inner race having a bearing surface; an outer race having a bearing surface; an axially oriented wedge in contact with both the inner race and the outer race and configured to increase distance between the inner race bearing surface. The outer race bearing surface with wedge movement in one direction while permitting distance between the inner race bearing surface and the outer race bearing surface to decrease with wedge movement in an opposite direction. A second axially oriented wedge in contact with both the inner race and the outer race and configured to increase distance between the inner race bearing surface and the outer race bearing surface with wedge movement in one direction while permitting
(Continued)

distance between the inner race bearing surface and the outer race bearing surface to decrease with wedge movement in an opposite direction.

10 Claims, 4 Drawing Sheets

(51) Int. Cl.

| | |
|---|---|
| ***E21B 34/14*** | (2006.01) |
| ***E21B 17/00*** | (2006.01) |
| *E21B 33/00* | (2006.01) |
| *E21B 34/00* | (2006.01) |

(52) U.S. Cl.
CPC ... *E21B 2033/005* (2013.01); *E21B 2034/007* (2013.01)

(58) Field of Classification Search
USPC ..... 166/316
See application file for complete search history.

(56) References Cited

U.S. PATENT DOCUMENTS

| | | | |
|---|---|---|---|
| 2003/0183392 | A1 | 10/2003 | Garay et al. |
| 2011/0297254 | A1 | 12/2011 | Geddes et al. |
| 2014/0224496 | A1 | 8/2014 | Hguyen et al. |

* cited by examiner

DIFFUSER AND FLOW CONTROL SYSTEM WITH DIFFUSER

CROSS REFERENCE TO RELATED APPLICATIONS

This application claims priority to U.S. provisional application 62/106,255, filed Jan. 22, 2015, the entire contents of which are incorporated herein by reference.

BACKGROUND

Flow control systems that experience large differential pressures when closed often suffer from seal degradation when opened. This is common in downhole industries as differential pressure is a ubiquitous condition. In order to protect the seals and increase longevity thereof, and by association the working life of the flow control system, the art has tried and used many different means of reducing flow to mitigate flow cutting of the seals. These include shaped ports in the flow control system, diffusers, etc.

Focusing on diffusers, the available configurations have had some success for their intended purposes but they can lack sufficient functionality, create other damage or are overly complex. Commonly it is very difficult to achieve a constant gap around a diffuser through an expected differential pressure operating range from tubing to annulus or from annulus to tubing and consequently many diffusers still allow more fluid flow than would otherwise be desirable for an optimal seal life. The problem of flow cutting is pervasive and not likely to lack importance in the near future and accordingly the art is always receptive to improvements.

SUMMARY

A diffuser including an inner race having a bearing surface; an outer race having a bearing surface; an axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction; and a second axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction.

A flow control system including a mandrel having one or more ports; one or more seals in sealing contact with the mandrel; a housing positioned about the mandrel and one or more seals and in sealing contact with the one or more seals; and one or more diffusers placed in a fluid pathway of the flow control system, the one or more diffusers including an inner race having a bearing surface; an outer race having a bearing surface; an axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction; and a second axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction.

A borehole system including one or more flow control systems disposed along the borehole system at least one of the one or more flow control systems including a diffuser including an inner race having a bearing surface; an outer race having a bearing surface; an axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction; and a second axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
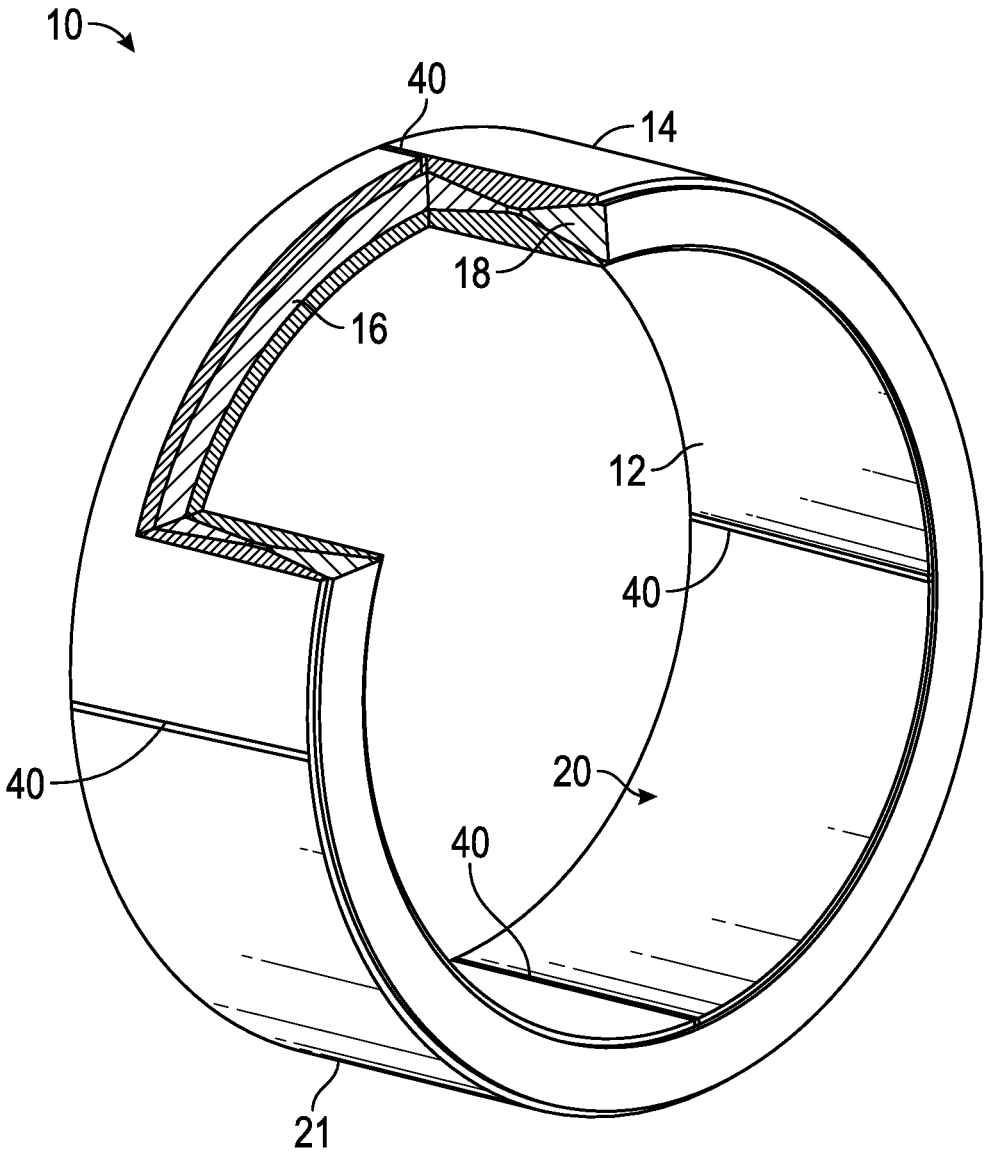
FIG. 1 is an isometric cutaway view of a diffuser as disclosed herein.

Referring to FIG. 1, a diffuser 10 is illustrated. Diffuser 10 comprises an inner race 12, an outer race 14, an axially oriented wedge 16 and a second axially oriented wedge 18. These components work together to ensure that the diffuser will occupy substantially all of the annular space between adjacent tubular structures in which the diffuser 10 is disposed. By substantially all of the space it is meant that a bearing surface 20 of the inner race 12 and a bearing surface 21 of the outer race 14 are both in contact with structure radially inwardly adjacent and radially outwardly adjacent of the diffuser when in use. Effectively this will ensure that the diffuser 10 will have an optimum utility, or in other words, that the diffuser will not allow fluid past the diffuser that is not directed by the diffuser. Accordingly, the flow of fluid past the diffuser is controlled by design of the diffuser rather than by a combination of design and unchecked leakage around the diffuser.

Figure 2:
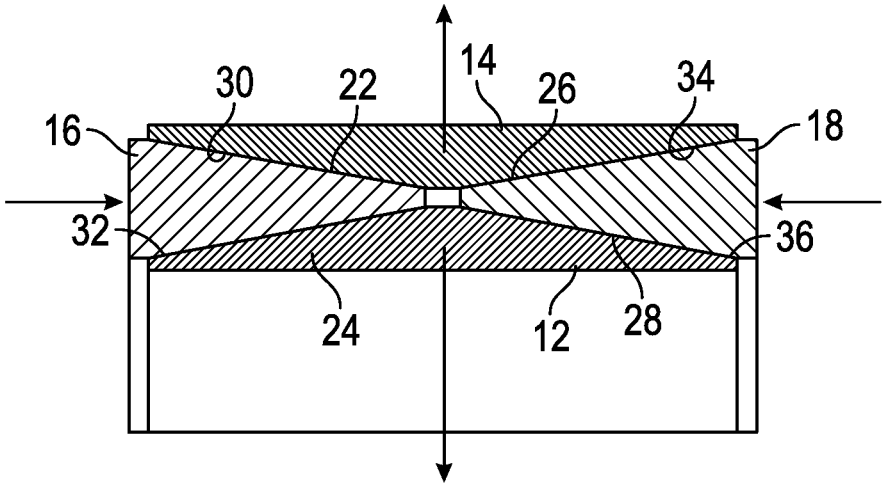
FIG. 2 is a cross section view of FIG. 1 taken along section line a-a illustrating a first condition.
Figure 3:
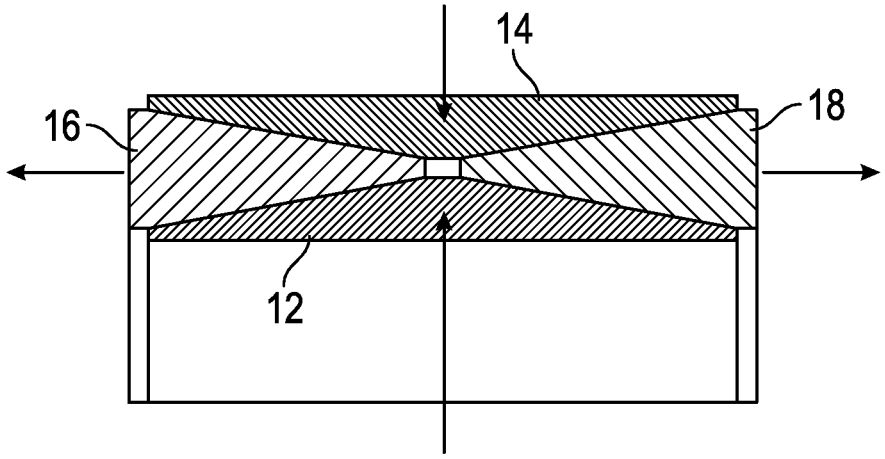
FIG. 3 is a cross section view of FIG. 1 taken along section line a-a illustrating a second condition.

With reference to FIGS. 2 and 3, operation of the diffuser 10 is illustrated. For clarity, it is to be understood that the diffuser as disclosed herein is configured to "follow" the elastic effects or movements of the tubulars in which it is placed rather than to cause those effects or movements. The wedges and spring, together, function to maintain the races in contact with the respective structures radially inwardly and radially outwardly thereof through the effects or movements. In FIG. 2, the wedges 16 and 18 are urged toward one another thereby forcing inner race 12 to move radially inwardly and outer race 14 to move radially outwardly pursuant to wedge surfaces 22 and 24 and wedge surfaces 26 and 28 working against race surfaces 30, 32, 34 and 36, respectively. Alternately stated, the wedge is configured to increase distance between the inner and outer races with wedge movement in one direction while permitting distance between inner and outer races to decrease with wedge movement in an opposite direction. This is effected by configuring each of these surfaces in a tapered form in an axial direction of the diffuser to result in the action described. Similarly, referring to FIG. 3, the opposite action is also contemplated. In the event there is a collapse pressure (acting in the direction of arrow "COLLAPSE") and/or a burst pressure (acting in the direction of arrow "BURST") will cause the wedges 16 and 18 to move axially away from one another thereby allowing the inner and outer races to move radially toward each other resulting in a smaller dimension measured from bearing surface 20 to bearing surface 21. Using these movements, the bearing surfaces stay in contact with structure radially inwardly and outwardly but does not cause damage due to the responsiveness to collapse and burst pressures on the diffuser.

In an embodiment, the angle of the surfaces 26 and 28 and the mating faces 34 and 36 is in a range of from about 8 degrees to about 15 degrees ("about" meaning +/−10%) relative to an axial centerline of the diffuser 10 and in one embodiment the angle is 10 degrees.

The inner and/or outer races 12 and 14 in some embodiments may each be parted at least one parting line 40 and may comprise any number of parting lines limited only by practicality. In one example, the inner race is two pieces roughly C shaped and/or the outer race is in two pieces roughly C shaped. Parting lines 40, which are a gap in the continuity of the material of the race enable the races to change in diametrical dimension pursuant to input from the wedges 16 and 18 or pursuant to burst or collapse pressure (see FIG. 3) where the material of the races is metal or other similarly limited elasticity/resilience material. Such materials include carbon steels, austenitic nickel-chromium based alloys, stainless steels, other alloys, etc. It is to be appreciated however that should the material of the race be selected from a class of materials that exhibit elasticity and compressibility, the parting lines would not be needed for the diametrical dimension adjustability of the diffuser. Nevertheless, even in such an embodiment, in order for the diffuser to do the job for which it is intended, there must be a fluid pathway that is created. The parting lines 40 can also perform that function so they may be included in some embodiments regardless of elasticity or compressibility of the material of the races. Alternatively, in some embodiments, the diffuser 10 may include materials that are porous in nature in order to provide a tortuous pathway for fluid pass through or they may be provided with machined fluid pathways other than the parting lines 40 or both. In such embodiments, it may not be necessary for the parting lines to be included at all. In the embodiment illustrated in FIG. 1, there are two parting lines 40 for each race such that each race comprises two semicircular sections. As noted, more parting lines or fewer can be used. Further, the wedges 16 and/or 18 may be configured with parting lines or as single circular configurations.

Surface finish is desirably within a range of about rms (root mean square) 125 to about rms 16 ("about" meaning +/−10%) for some embodiments and in one embodiment is rms 63.

When employed in a flow control system, the diffuser 10 may be employed as a plurality of diffusers 10, the number of diffusers selected being related to the degree of diffusion desired for a particular utility. The more diffusers used, the greater the reduction in flow rate of fluid there through. In the event multiple diffusers are employed in a system, and the diffusers 10 used include parting lines 40, the lines 40 of adjacent diffusers 10 should be rotated out of alignment with each other. Stated alternatively, the parting lines 40 of one diffuser should be oriented for example 90 degrees off the orientation of the other diffuser. This ensures that the parting lines do not provide a "straight shot" fluid pathway through the diffusers. Rather, by misaligning the parting lines a tortuous path is created for fluid thereby supporting the purpose of the diffusers 10.

Figure 4:
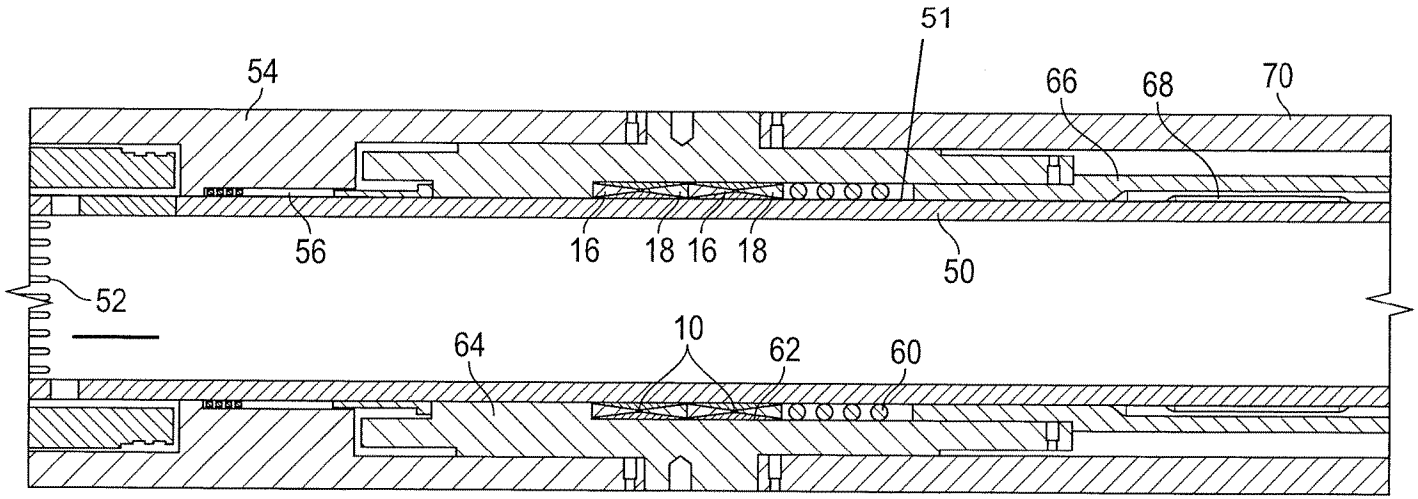
FIG. 4 is a cross section view of a flow control system having the diffuser hereof in a closed condition.
Figure 5:
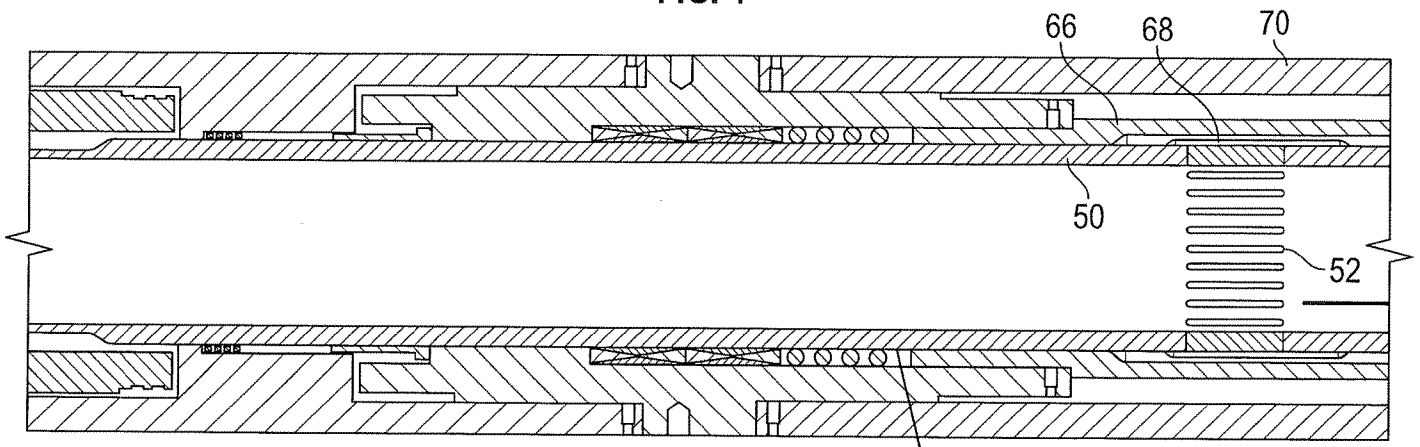
FIG. 5 is a cross section view of a flow control system having the diffuser hereof in an open condition.

Referring to FIGS. 4 and 5, a flow control system 48 is illustrated showing the system in a closed position (FIG. 4) and an open position (FIG. 5). Two diffusers 10 are present in this embodiment. It will be understood that more or fewer may be employed. The system includes a mandrel 50 having a number of ports 52. The mandrel is sealed to a housing 54 by one or more seals 56. This is the seal(s) that the diffuser(s) 10 are used to protect. As will be appreciated by one of ordinary skill in the art, the challenge to the seal(s) 56 occurs as the ports 52 begin to open to the pressure that the seal(s) were previously separating. Where the differential is high, the seal(s) are often damaged by flow cutting. The diffusers 10 are energized by energizer 60, which may be a coil spring as illustrated, a wave spring, a foam spring a swellable, a shape memory material, a piston, or any other configuration that will exert an axial force on the wedges of the diffuser such that the inner race(s) 12 of the diffuser will remain in contact with a surface 51 of the mandrel 50 and the outer race(s) 14 will remain in contact with a surface 62 of a diffuser housing 64. Downhole of the diffuser housing 64 is a sleeve housing 66 with housing ports 68 and outer housing 70. The flow path as the ports 52 emerge from under seals 56 is between the inside of mandrel 50 to between the sleeve housing 66 and the outer housing 70. Regardless of the direction of flow between these two points (dictated by pressure differential), the diffuser(s) present a tortuous pathway for fluid and accordingly will protect the seal(s) from flow cutting. Referring to FIG. 5, the flow control system is fully open and the one or more seals is/are no longer subject to flowing fluid.

Figure 6:
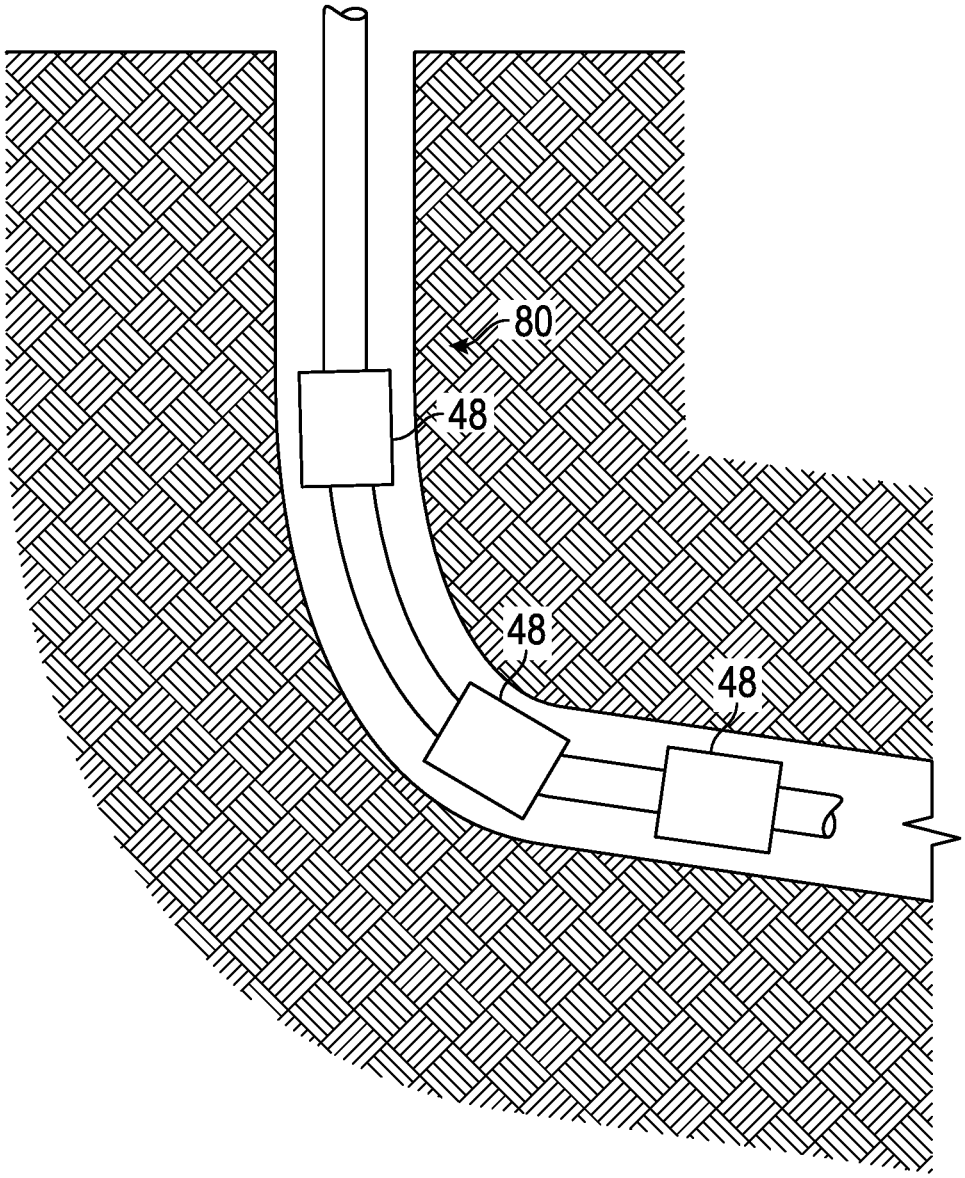
FIG. 6 is a schematic view of a borehole with a number of flow control systems illustrated therein.

Referring to FIG. 6, a borehole system 80 is generally illustrated having one or more flow control systems as disclosed herein disposed along the length of the borehole system at least one of the flow control systems including a diffuser as described and claimed herein.

Set forth below are some embodiments of the foregoing disclosure:

Embodiment 1

A diffuser comprising: an inner race having a bearing surface; an outer race having a bearing surface; an axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction; and a second axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction.

Embodiment 2

The diffuser of embodiment 1 wherein one or both of the inner and outer races includes one or more parting lines.

Embodiment 3

The diffuser of embodiment 1 wherein the diffuser comprises metal.

Embodiment 4

The diffuser of embodiment 1 wherein the diffuser comprises polymeric material.

Embodiment 5

The diffuser of embodiment 1 wherein the inner and outer races comprise surfaces having an angle relative to an axis of the diffuser of about 8 degrees to about 15 degrees.

Embodiment 6

The diffuser of embodiment 1 wherein a surface finish for one or more of the components of the diffuser is in the range of about rms 125 to about rms 16.

Embodiment 7

A flow control system comprising: a mandrel having one or more ports; one or more seals in sealing contact with the mandrel; a housing positioned about the mandrel and one or more seals and in sealing contact with the one or more seals; and one or more diffusers placed in a fluid pathway of the flow control system, the one or more diffusers including an inner race having a bearing surface; an outer race having a bearing surface; an axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction; and a second axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction.

Embodiment 8

The flow control system of embodiment 7 further comprising an energizer in operative contact with the one or more diffusers.

Embodiment 9

The flow control system of embodiment 8 wherein the energizer is a spring.

Embodiment 10

A borehole system comprising: one or more flow control systems disposed along the borehole system at least one of the one or more flow control systems including a diffuser including an inner race having a bearing surface; an outer race having a bearing surface; an axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction; and a second axially oriented wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

The invention claimed is:

1. A diffuser comprising:

an inner race including an annularly shaped surface and having a bearing surface and an axis;

an outer race including a annularly shaped surface and having a bearing surface and an axis;

a wedge including a frustoconically shaped surface having an axis that is coaxial with the axes of the inner and outer races, the wedge in contact with both the inner race and the outer race and configured to increase distance between the inner race bearing surface and the outer race bearing surface with axial wedge movement in one direction while permitting distance between the inner race bearing surface and the outer race bearing surface to decrease with wedge movement in an opposite direction; and a second wedge including a frustoconically shaped surface having an axis that is coaxial with the axes of the inner and outer races, the wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction.

2. The diffuser as claimed in claim 1 wherein one or both of the inner and outer races includes one or more parting lines.

3. The diffuser as claimed in claim 1 wherein the diffuser comprises metal.

4. The diffuser as claimed in claim 1 wherein the diffuser comprises polymeric material.

5. The diffuser as claimed in claim 1 wherein the inner and outer races comprise surfaces having an angle relative to an axis of the diffuser of about 8 degrees to about 15 degrees.

6. The diffuser as claimed in claim 1 wherein a surface finish for one or more of the components of the diffuser is in the range of about rms 125 to about rms 16.

7. A flow control system comprising:

a mandrel having one or more ports;

one or more seals in sealing contact with the mandrel;

a housing positioned about the mandrel and one or more seals and in sealing contact with the one or more seals; and one or more diffusers placed in a fluid pathway of the flow control system, the one or more diffusers including an inner race including an annularly shaped surface and having a bearing surface and an axis;

an outer race including a annularly shaped surface and having a bearing surface and an axis;

a wedge including a frustoconically shaped surface having an axis that is coaxial with the axes of the inner and outer races, the wedge in contact with both the inner race and the outer race and configured to increase distance between the inner race bearing surface and the outer race bearing surface with axial wedge movement in one direction while permitting distance between the inner race bearing surface and the outer race bearing surface to decrease with wedge movement in an opposite direction; and a second wedge including a frustoconically shaped surface having an axis that is coaxial with the axes of the inner and outer races, the wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction.

8. The flow control system as claimed in claim 7 further comprising an energizer in operative contact with the one or more diffusers.

9. The flow control system as claimed in claim 8 wherein the energizer is a spring.

10. A borehole system comprising:

one or more flow control systems disposed along the borehole system at least one of the one or more flow control systems including a diffuser including an inner race including an annularly shaped surface and having a bearing surface and an axis;

an outer race including a annularly shaped surface and having a bearing surface and an axis;

a wedge including a frustoconically shaped surface having an axis that is coaxial with the axes of the inner and outer races, the wedge in contact with both the inner race and the outer race and configured to increase distance between the inner race bearing surface and the outer race bearing surface with axial wedge movement in one direction while permitting distance between the inner race bearing surface and the outer race bearing surface to decrease with wedge movement in an opposite direction; and a second wedge including a frustoconically shaped surface having an axis that is coaxial with the axes of the inner and outer races, the wedge in contact with both the inner race and the outer race and configured to increase distance between the inner race bearing surface and the outer race bearing surface with wedge movement in one direction while permitting distance between the inner race bearing surface and the outer race bearing surface to decrease with wedge movement in an opposite direction.

* * * * *